US009370231B2

(12) United States Patent
Sansole et al.

(10) Patent No.: US 9,370,231 B2
(45) Date of Patent: Jun. 21, 2016

(54) HAIR CARE APPARATUS

(75) Inventors: Palesa Sansole, Amersham (GB); Hans Henrik Petersen, Cambridge (GB); Andrew Robert James Russell, Cambridge (GB); Roderick McBrien, Leamington Spa (GB); Digby Redshaw, Warwick (GB); Neil Bowker, Leamington Spa (GB)

(73) Assignee: Palock Limited, Amersham (GB)

( * ) Notice: Subject to any disclaimer, the term of this patent is extended or adjusted under 35 U.S.C. 154(b) by 360 days.

(21) Appl. No.: 13/451,690

(22) Filed: Apr. 20, 2012

(65) Prior Publication Data

US 2012/0325262 A1 Dec. 27, 2012

(30) Foreign Application Priority Data

Apr. 21, 2011 (GB) ..... 1106950.7

(51) Int. Cl.
*A45D 2/12* (2006.01)
*A45D 7/00* (2006.01)
*A45D 2/02* (2006.01)

(52) U.S. Cl.
CPC .. *A45D 7/00* (2013.01); *A45D 2/02* (2013.01); *A45D 2007/004* (2013.01)

(58) Field of Classification Search
CPC ..... A45D 2002/003–2002/007; A45D 2/00; D02G 1/02; D01H 4/16; D01H 4/00
USPC ..... 132/210, 212, 333, 222, 238, 273, 132/280–284, 226, 56, 271; 57/28, 4, 12, 57/59; 87/33, 62
See application file for complete search history.

(56) References Cited

U.S. PATENT DOCUMENTS

| | | | | | |
|---|---|---|---|---|---|
| 4,322,944 | A * | 4/1982 | Sraitr et al. | 57/328 |
| 4,369,690 | A * | 1/1983 | Sapkus | 87/33 |
| 4,824,036 | A * | 4/1989 | Buta | 242/442 |
| 5,119,847 | A * | 6/1992 | Powell et al. | 132/226 |
| 5,488,963 | A * | 2/1996 | Fishman | 132/212 |
| 5,671,759 | A * | 9/1997 | Chung et al. | 132/271 |
| 5,725,000 | A * | 3/1998 | Rice | 132/210 |
| 6,089,240 | A * | 7/2000 | Chang | 132/273 |
| 6,109,275 | A * | 8/2000 | Mendezmonsanto | 132/212 |
| 6,637,441 | B2 * | 10/2003 | Kennedy et al. | 132/212 |
| 6,662,808 | B2 * | 12/2003 | Leason et al. | 132/212 |
| 2001/0052347 | A1 * | 12/2001 | Kennedy et al. | 132/212 |
| 2003/0168074 | A1 * | 9/2003 | Leason et al. | 132/212 |
| 2004/0237991 | A1 * | 12/2004 | Glucksman et al. | 132/271 |
| 2005/0077421 | A1 * | 4/2005 | Hernandez et al. | 242/587.2 |
| 2005/0109367 | A1 * | 5/2005 | Smith | 132/333 |
| 2010/0006117 | A1 * | 1/2010 | Gutierrez Ugarte | 132/212 |

FOREIGN PATENT DOCUMENTS

| | | | |
|---|---|---|---|
| JP | 2002-165628 | * | 6/2002 |
| KR | 10-0478813 | * | 11/2001 |

OTHER PUBLICATIONS

Translation of Lee et al. Nov. 2001.*
Translation of Hase et al. Jun. 2002.*

* cited by examiner

*Primary Examiner* — Todd E Manahan
*Assistant Examiner* — Brianne Kalach
(74) *Attorney, Agent, or Firm* — Nixon Peabody LLP

(57) ABSTRACT

An apparatus for dreadlocking hair comprising a motor and a means for holding or engaging a strand of hair. The holding means is rotated by the motor, so that the strand of hair is twisted into a dreadlock, that is, a twisted bundle of hair where hair on the surface of the bundle describes a purely helical path, at least in a newly dreadlocked part of the strand.

1 Claim, 20 Drawing Sheets grabber sprung closed
move to open 720
730
820
790

790
800

720
730
810
740
820
780
760
800
closed 720
750
810
790
790
760

720/730
740
780
820
800/810
open 710
750
700
760
790
770
720
780
810

Fig. 15A
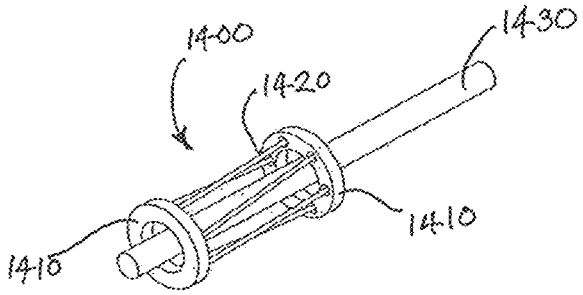
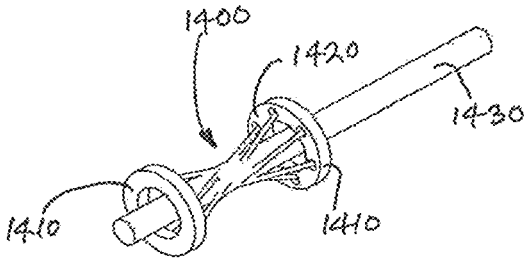
Fig. 15B concept D2 concept D1

HAIR CARE APPARATUS

CROSS-REFERENCE TO RELATED APPLICATION

This application claims the benefit under 35 U.S.C. §119 of Great Britain Patent Application Serial No. 1106950.7, filed in Great Britain on Apr. 21, 2011, entitled "Hair Care Apparatus."

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

Embodiments relates to apparatus for dreadlocking hair.

BACKGROUND

Hair can be arranged in dreadlocks (hereinafter referred to as locking) manually by holding a strand of hair with one hand close to the scalp and by twisting a distal part of the strand of hair with another hand. When referring to a strand of hair reference is being made to more than one hair in a bundle. In doing so the part of the strand of hair that is to be locked is arranged in a tight twist. Hair wax may be applied to the part of the strand of hair that is to be (dread-) locked, so that the twist of the hair is retained after the manually applied twisted tension is removed.

From the above it will be appreciated that dreadlocking hair involves a considerable amount of effort. Moreover, newly grown parts of the strand of hair will need to be locked on a regular basis, so that the hair not only needs to be locked at an initial stage but also regularly thereafter, potentially as often as weekly. This is labour as well as cost intensive. It is moreover difficult for individuals to dreadlock their own hair.

SUMMARY OF INVENTION

According to an aspect of the present invention there is provided an apparatus for locking hair. The apparatus comprises a holder for engaging a single strand of hair. The holder is driveably connected with an electric motor so that operation of the electric motor causes a rotation of the holder applying a twisting locking motion to an unlocked part of a strand of hair in the holder. The holder of the above described apparatus is arranged to engage the strand of hair so that a distal free end of the strand of hair can rotate or spin freely. Allowing the free end of a strand of hair to spin freely (with the rotating motion imparted upon the proximal parts of the strand of hair by the apparatus) avoids the need to grab the strand of hair at its free end. In cases where hair is to be re-locked, that is where parts of the hair is already locked and only a region of new hair growth needs to be locked, the strand of hair can be engaged/grabbed close to the scalp, so that only the part of the strand of hair that needs to be re-locked is rotated and tightened by the apparatus. The part of the strand of hair distal from the clamp can then freely rotate with the rotation of the holder so that this part of the strand of hair is not unnecessarily re-tensioned.

Locking a strand of hair includes twisting the strand of hair about the stand's longitudinal axis creating a matted lock of entangled hair. This twisting action twists the hair into a yarn like configuration, that is, into a bundle of hair in which the individual hairs at the surface describe a substantially purely helical path. With increasing rotation of the strand of hair the tightness and density of the locked strand can increase. Gel or wax may be used to keep the hair in dreadlocks. It should be noted that the part of the strand of hair that is held by the holder does not itself have to be twisted exclusively about its longitudinal axis. Instead, the strand of hair that is being held by the holder may be twisted about its longitudinal axis while, at the same time, being rotated about another axis. The part of the strand of hair that is required to be twisted exclusively about its longitudinal axis is the part of the strand of hair closest to the scalp. Due to the natural growth of the hair this part of the strand of hair is the part that is likely to be unlocked (that is not arranged in a dreadlock), even if a more distal part of the strand of hair has been locked before.

Locking of hair is not to be confused with the twisting of hair or with braiding it. Twisting of hair involves the rotation of two or more strands of hair about a common longitudinal axis, much like several yarns are twisted about a common longitudinal axis when forming a thicker yarn or a rope, whereas the above described locking involves the twisting of a single strand of hair about its longitudinal axis. Braiding involves the interleaved arrangement of several strands of hair in an ordered fashion and does not have to involve a twisting motion at all. Braiding therefore does not involve creating matted locks as locking does or involve the deliberate entanglement of hair.

The holder may comprise a tubular structure for receiving the strand of hair in the middle/in a bore. The tubular structure may comprise an engagement means for engaging the strand of hair. This engagement means may be provided at an end of the tubular structure. The engagement means may comprise one or more cuts or slits in the wall of the tubular structure. One or more of these cuts or slits may narrow over their length.

The holder may comprise more than one engagement means for engaging the strand of hair. Different ones of the said engagement means may have different sizes for engaging strands of hair with differing diameters. If the engagement means are the above mentioned narrowing cuts/slits, then different cuts/slits may, for example, narrow to different final width. One or more of the slits may have an individual receptacle at the end/narrowest portion, wherein different receptacles may have different sizes to hold different diameter strands of hair.

The apparatus may further comprise a fixator for engaging the strand of hair and for inhibiting twisting of the strand of hair about its longitudinal axis. Any such fixator may be spaced apart from the holder and be arranged to prevent rotation or reduce the amount of rotation of the strand of hair on a side of the fixator opposite from the holder.

The fixator may comprise an adjustable opening that engages a strand of hair in one opening position (of reduced diameter) and that allows insertion or removal of the strand of hair from the fixator in another opening position (with increased diameter). The fixator may, for example, comprise an iris-type closure, a biasing means suitable for and arranged to bias a strand of hair against a non-rotating part of the apparatus and/or one or more resilient members arranged to contact the strand of hair.

The holder may comprise a surface for engaging the strand of hair and means for biasing the strand of hair against the surface. The motor may be arranged to move the surface so that the surface moves tangentially to a surface of the strand of hair biased against the surface. The surface may be provided inside of an opening of the holder. The surface may have a geometry and/or materials that aid the engagement of the surface with the strand of hair. The surface may, for example, comprise teeth, as may be found on cogs, serrations or forms of undulations or unevenness that increase friction between the strand of hair and the surface. The biasing means may be arranged to be moveable relative to the opening, so that in one position of the biasing means relative to the opening a large opening for insertion of the strand of hair is provided and in another position the biasing means biases the strand of hair against the surface.

The biasing means may comprise an opening with a surface and may also be rotationally connected with the electric motor in a manner so that the rotation of the biasing means and rotation of the holder together induce a rotation of the strand of hair, in use.

The width of an opening on one end of the tubular structure may be larger than the width at the other end of the tubular structure. The tubular structure may have a tapering internal surface.

According to another aspect of the present invention there is provided a method of forming a dreadlock on a person from a strand of hair or from a part of the strand, preferably the part of the strand closest to the scalp of the person. The method comprises separating a strand of hair from surrounding hair, using a holder of a dreadlocking apparatus to engage with the strand of hair so that a distal portion of the strand of hair can move freely, activating a motor of the apparatus and disengaging the strand of hair from the holder after deactivation of the motor. The motor is arranged to rotate the holder, and with it the strand of hair by virtue of the engagement between the holder and the strand of hair, thereby twisting a portion of the strand of hair between the holder and the scalp of the person.

BRIEF DESCRIPTION OF THE DRAWINGS

Embodiments will be described in the following by way of example only and with reference to the accompanying drawings, in which:

FIGS. 11 to 18 show further embodiments of the invention.

DETAILED DESCRIPTION

Figure 1:
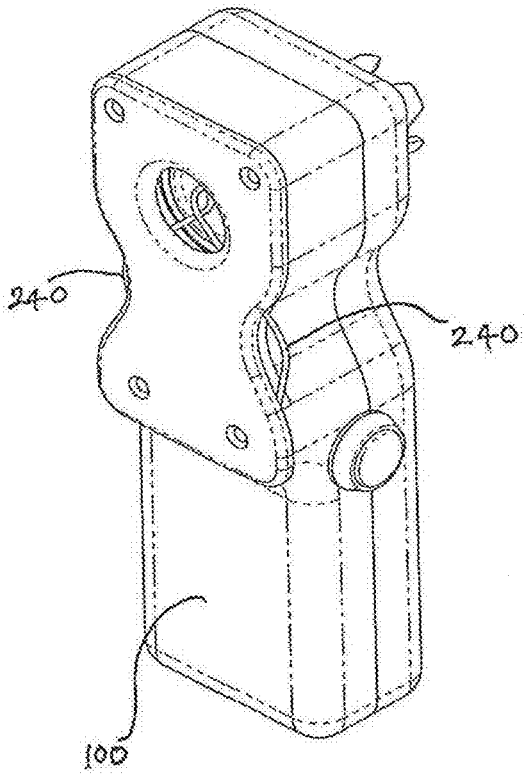
FIG. 1 shows an apparatus according to an embodiment.
Figure 2:
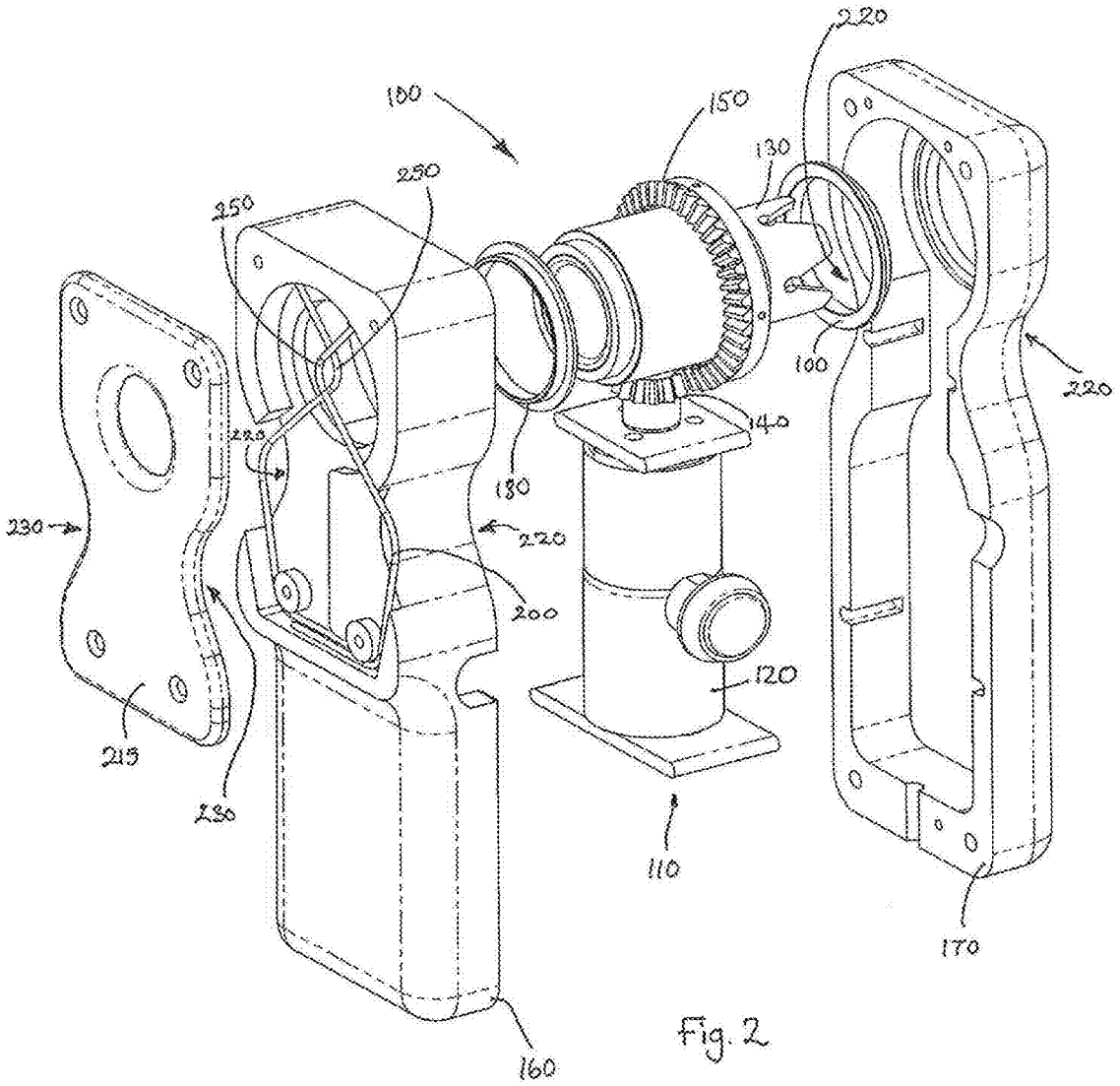
FIG. 2 shows an explosion diagram of the apparatus illustrated in FIG. 1.
Figure 4:
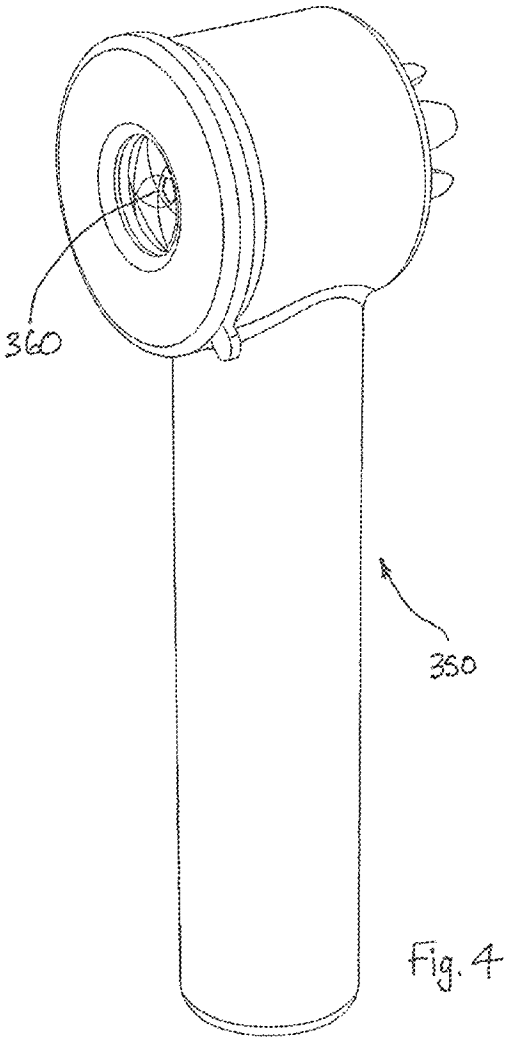
FIGS. 4 to 9 show further apparatus according to an embodiment.
Figure 5:
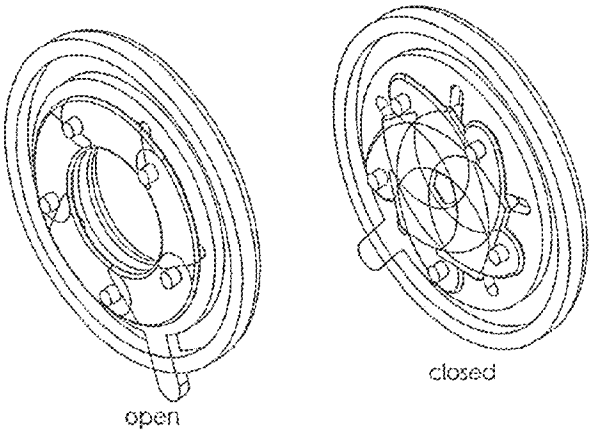

FIG. 1 shows a first apparatus 100 according to an embodiment. Details of the apparatus 100 are shown in the explosion diagram of FIG. 2. At the centre of the apparatus is a unit 110 that comprises both the motor 120 and the holder 130 for the strand of hair. As can be seen from FIG. 2 in this embodiment the motor forms part of a handle portion of the apparatus 100. Connected to the motor 120 is a first bevel gear 140. The motor 120 causes the first bevel gear 140 to rotate about its axis (which in FIG. 2 is the vertical axis). The bevel gear 140 in turn drives a second bevel gear 150. The second bevel gear 150 is fixedly attached to the holder 130 and rotates, together with the holder 130, about the longitudinal axis of the holder 130. Transmission of motion from the motor 120 to the holder 130 in this fashion provides the advantage that the spaces on either side of the holder 130 is not occupied by the motor, so that the strand of hair that is to be locked can be freely inserted through the opening in the holder and can freely exit from the holder.

The unit 110 is provided in a housing comprised of two housing halves 160 and 170 respectively. The holder 130 is rotatably held within the housing parts 160 and 170 by collars 180 and 190.

Also provided as part of the apparatus 100 are springs 200 and 210. As can be seen from FIGS. 1 and 2 the springs form, where they overlap, an opening. As can be seen from FIG. 2, both of the springs 200 and 210 are fixed to the housing part 160 at one end. While it is shown that both springs are fixed to the housing at the same end, this is not essential and the springs may be fixed to the housing at opposing ends). Housing half 160 and lid 215 enclose most of the springs 200 and 210. As can be seen from FIG. 2, the housing parts 160 and 170 as well as the lid 215 comprise recesses 220 and 230. FIG. 1 shows that these recesses expose parts 240 of the springs 200 and 210 when the apparatus is in the assembled state. These parts 240 can pushed inwardly by the user, thereby causing the bent portions 250 of the springs 200 and 210 in the area where the springs overlap to move away from a centre of the opening they define, thereby increasing the size of the opening to enable the insertion of a strand of hair through the opening. Removal of force from the springs will cause the opening to close again under the resilient force of the springs to engage the strand of hair and to prevent or reduce rotation of the parts of the strand of hair that lie outside of the apparatus 100, to the left of the springs 200 and 210 in FIGS. 1 and 2.

Figure 3:
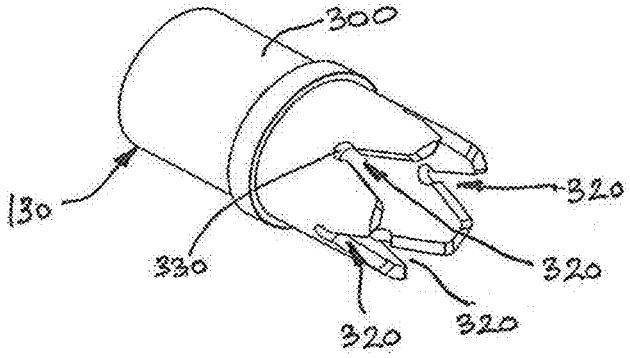
FIG. 3 shows details of the holder of the FIG. 1 apparatus.

FIG. 3 shows the holder 130 in more detail. The holder 130 comprises a tubular structure 300 terminating in end portion 310. The tubular structure is provided to carry the second bevel gear 150 shown in FIG. 2 as well as the collars 180 and 190. The end portion 310 comprises narrowing slits 320. Each narrowing slit 320 has a circular recess 330 at its end. The recesses 330 are intended to receive a strand of hair protruding from the bore of the tubular structure 300 and engage the strand of hair (the strand of hair may be considered as being clipped into the recess or hooked over the side wall of the tubular structure 300, extending through a recess 330). When so engaged, the strand of hair has a free end that protrudes radialy beyond the outer perimeter of the tubular structure 300. This free end can freely move with the rotating tubular structure 300, while the rotation of the tubular structure 300, aided by the engagement of the strand of hair provided by the recesses 330, imparts a twisting motion upon the part of the strand of hair extending through the bore of the tubular structure 300.

In one embodiment different recesses 330 have different sizes so that they can accommodate strands of hair with different diameters. The narrowing slits 320 may also differ in size to correspond to the different size recesses 330. The sections adjacent (for example between) the narrowing slits 330 may comprise a tactile marking, so that a person trying to lock his or her own hair can locate a desired recess 330 on the end portion 310 even when he or she is no longer able to see the end portion 310.

Turning now to the operation of the apparatus 100, a person locking hair presses the exposed portions 240 of the springs 200 and 210 so as to widen the opening defined by the springs. The strand of hair that is to be locked is then inserted into the holder through the opening defined by the springs 200 and 210 until the strand of hair protrudes from the holder 130 by a desired amount. This desired amount may depend on the locking state of the strand of hair. A strand of hair that is already locked and that only requires a re-locking of new growth may, for example, require that the strand of hair is inserted through the springs 200 and 210 and through the holder 130 until the springs are located close to the scalp. This may also be desirable in a situation where a fresh strand of hair is newly locked. In the latter situation it may, however, be necessary that the apparatus be repeatedly moved distally after an initial locking of a proximal part of the strand of hair.

Once the strand of hair has been inserted through the opening defined by the springs 200 and 210 the user disengages the spring portions 240, so that the springs 200 and 210 hold the strand of hair and inserts the strand of hair into an appropriate one of the recesses 330 at the end of a narrowing slit 320.

Once the strand of hair has been put in place in the above described manner the motor 120 can be activated (using a switch that is not shown in the figures). This causes the holder 130 to rotate about its longitudinal axis and twists the hair. It will be appreciated that, while at the location of the recess 330 the rotation of the strand of hair about the longitudinal axis of the holder 130 does not correspond to a pure rotation of the strand of hair about its own longitudinal axis. However, the rotation of the strand of hair is purely about its own longitudinal axis at the position of the springs 200 and 210 and beyond.

Turning now to FIGS. 4 to 8, the apparatus shown in these figures substantially correspond to the apparatus described above with reference to FIGS. 1 and 2 but have different fixators than the apparatus shown in FIGS. 1 and 2. As can be seen from FIGS. 4 to 8, none of the apparatus shown in these figures comprises the springs 200 and 210 shown in FIGS. 1 and 2. The apparatus 350 shown in FIG. 4 instead comprises an adjustable opening 360 formed by the iris type closure shown in FIG. 5.

Figure 6:
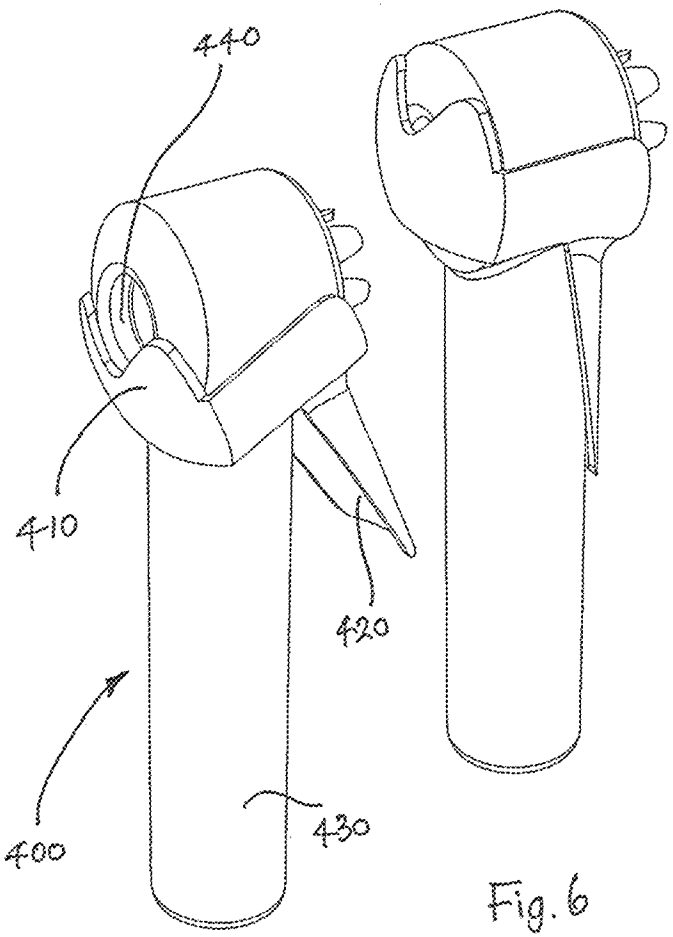

The apparatus 400 shown in FIG. 6 comprises a jaw 410 that is downwardly biased to the position shown to the left of FIG. 6. In this position the opening through the apparatus is accessible for the insertion of a strand of hair. When the handle 420 is pressed towards the motor unit 400 the jaw 410 moves upwardly and the overlap between the recess 440 in the jaw 410 and the opening in the holder decreases until the recess 440 in the jaw 410 engages the strand of hair and presses the strand of hair against an upper surface of the holder. This engagement again prevents or reduces rotation of the strand of hair outside of the apparatus 400.

Figure 7:
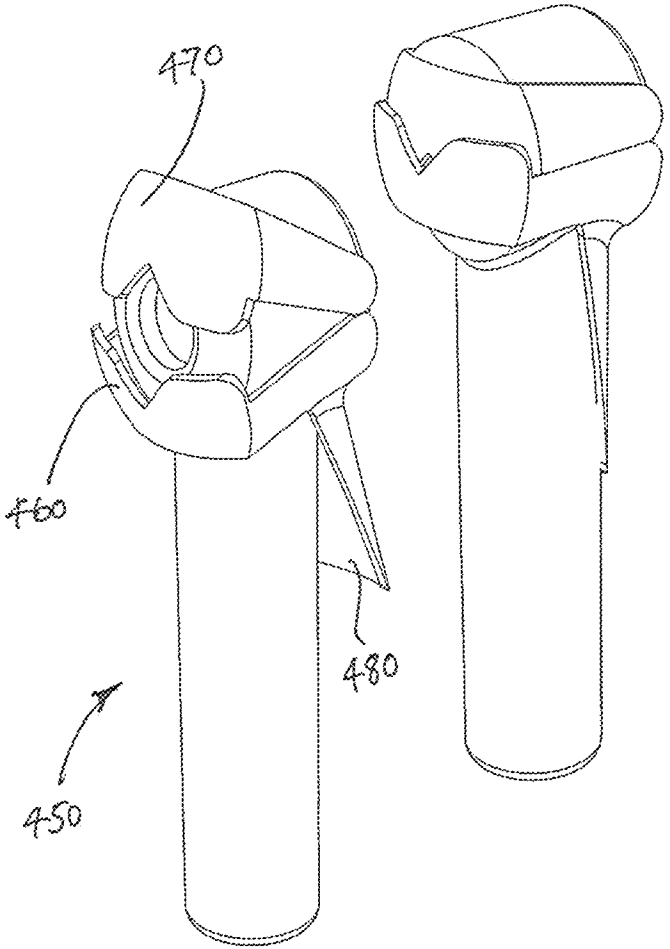

The apparatus 450 shown in FIG. 7 operates based on a similar principle as that shown in FIG. 6 but comprises two moveable jaws 460 and 470. The jaws 460 and 470 are biased towards the open position shown at the left of FIG. 7. Pressing of the handle 480 towards the motor unit moves the jaws 460 and 470 towards each other to engage and clamp the strand of hair inserted between the jaws 460 and 470.

Figure 8:
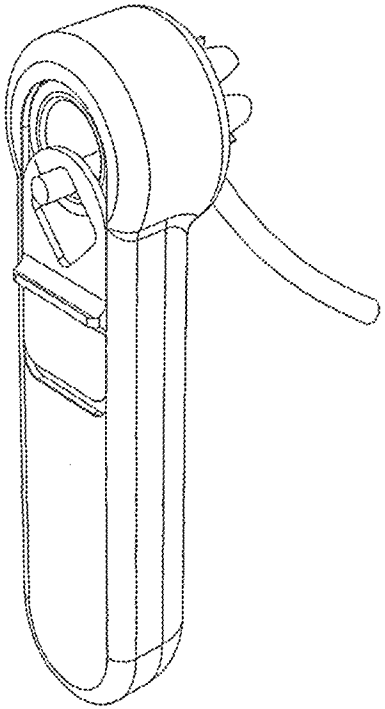
Figure 8:
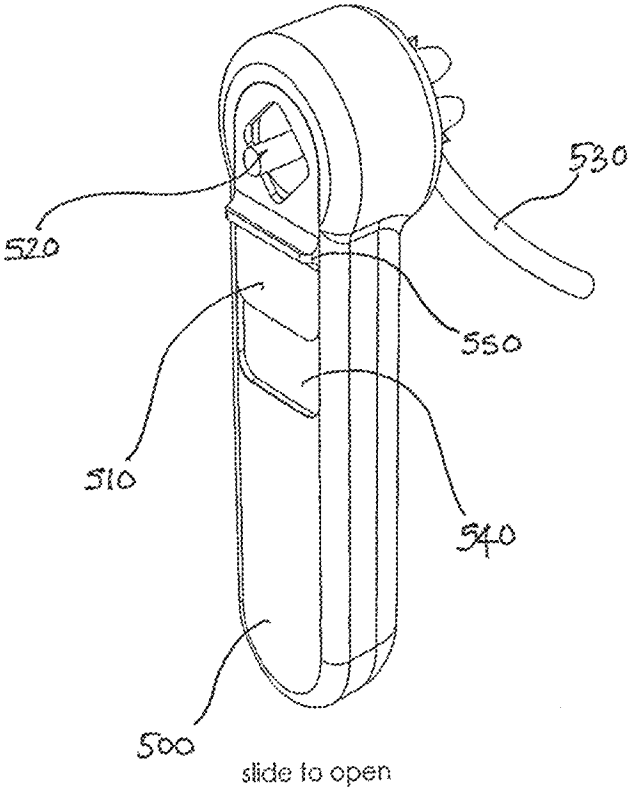

The apparatus 500 shown in FIG. 8 comprises a slider 510 with an opening 520. The slider 510 can be positioned in one position so that the opening 520 overlaps the opening in the holder 130 in a manner that allows insertion of a strand of hair 530. In another position the slider 510 is slid to a position where overlap between the opening 520 and the opening of the holder is reduced, so that a strand of hair is engaged/clamped, as shown in the right part of FIG. 8. The slider 510 is located in a guide groove 540 and can be moved along the guide groove using protruding ridge 550.

Figure 9:
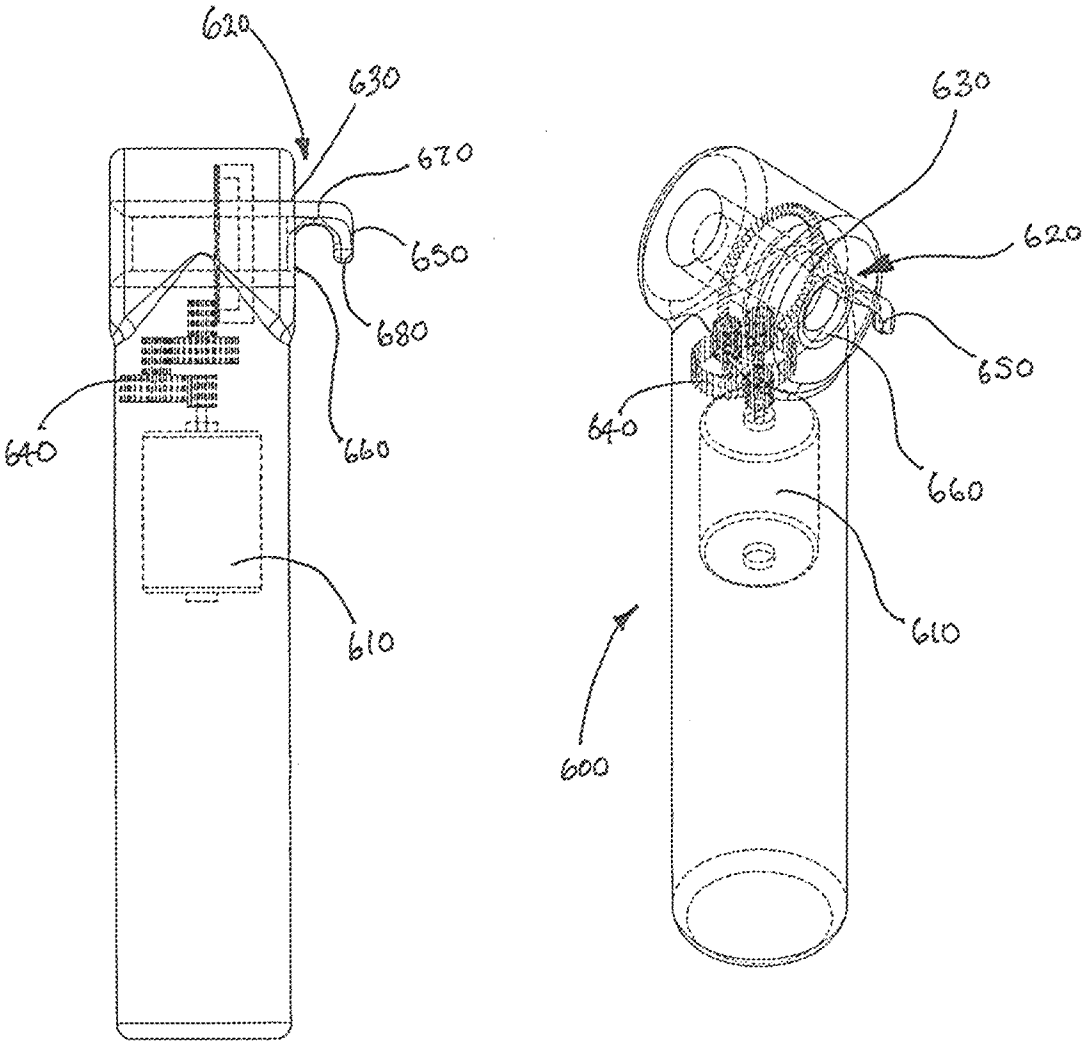

FIG. 9 shows another locking apparatus 600. The apparatus 600 comprises a motor 610 and a means 620 for engaging and twisting a strand of hair. The means 620 is tubular, as in the previously described embodiments, and comprises an opening 630 from which the strand of hair that is to be locked protrudes in use. It will be appreciated that, as is the case in the previously described embodiments, the motor 610 is driveably connected to the holder 620 so that the motor 610 in use rotates the holder 620 about its longitudinal axis, that is, about the axis extending centrally through the bore of the holder 620. A gear arrangement 640 driveably connects the motor 610 to the holder 630 and provides a desired speed conversion.

As can be seen from FIG. 9, the part of the holder 620 differs from the holder 130 discussed above with reference to the embodiments of FIGS. 1 to 8 in that it does not comprise the narrowing slits 320 and recesses 330 for firmly holding a strand of hair while the holder rotates. Instead, the holder 620 comprises an engagement hook 650. A portion 670 of the hook 650 is in contact with the end face 660 of the holder 620 and extends from this end face 660 in the longitudinal direction of the holder 620. A more distal part 680 of the hook 650 extends in a direction that is substantially tangential to the outer surface of the cylindrical tubular holder. The part 680 of the hook 650 has a curvature with a radius that is larger than the radius of the holder 620. It will, however, be appreciated that the hook may have a surface with a radius that corresponds to the radius of the holder 620.

In the embodiment the hook 650 as well as the tubular holder may be formed from a single tubular member, for example by milling. The motor 610 drives the holder 630 so that the free end of the hook 650 precedes the remainder of the hook 650 during rotation, so that the hook 650 can sweep up a strand of hair protruding from the opening 630. As seen in the right hand illustration provided in FIG. 9 this means that the hook rotates clockwise. It will be appreciated that a so engaged strand of hair may fold over the part 670 of the hook 650 as a result of the continuing rotation of the holder 620, thereby increasing frictional engagement between the hook 650 and the strand of hair and imparting a twisting motion onto the strand of hair in this fashion.

In the FIG. 9 embodiment the slot between the part 670 of the hook 650 and the end face 660 of the holder 620 is not a narrowing slot. It will, however, be appreciated that the width of this slot could be narrowing with increasing distance from the tip of the part 680 of the hook, so that engagement between the hook 650 and the strand of hair increases as the strand of hair is swept up by the hook 650.

FIGS. 10 A to F show another apparatus 700 for locking hair. The apparatus 700 comprises a motor 710 and two gearwheels 720 and 730. As can be seen from FIGS. 10 A to F, the two gearwheels 720 and 730 comprise teeth extending around an outer circumference thereof. Also provided are supports 740 and 750. Support 740 supports and is arranged concentrically with gearwheel 720. Gearwheel 720 can rotate relative to support 740, while remaining concentric with support 740. Support 750 supports and is arranged concentrically with gearwheel 730. Gearwheel 730 can rotate relative to support 750, while remaining concentric with support 750.

Figures 10A, 10B, 10C, 10D, 10E, 10F:
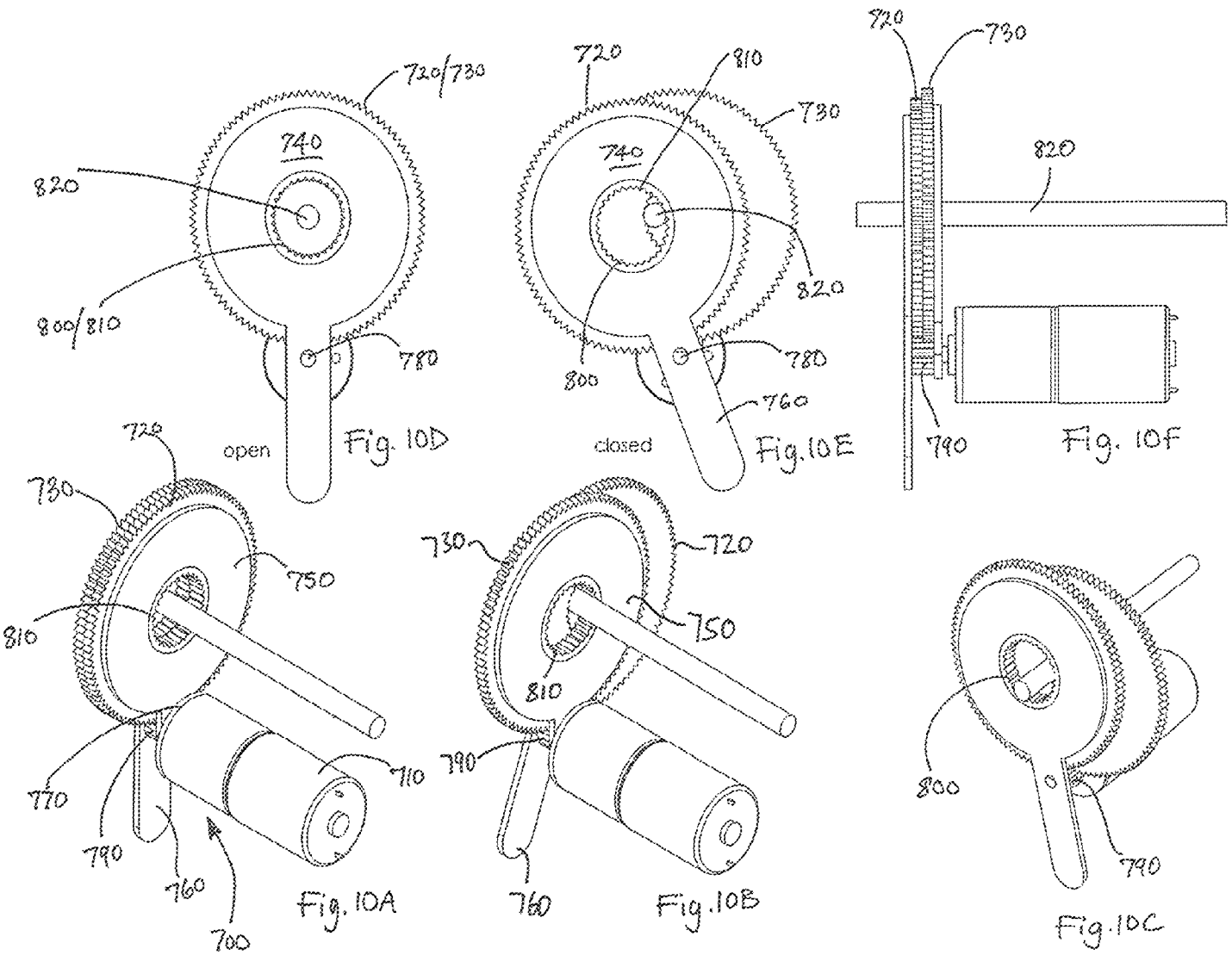
FIG. 10 shows yet another apparatus according to an embodiment.

The two supports 740 and 750 comprise respective extensions 760 and 770. The extensions 760 and 770 can move relative to each other by pivoting about pivot axis 780. FIGS. 10D and 10E show two different pivotal positions that the supports 740 and 750 can adopt relative to each other. Pivot axis 780 lies on the longitudinal axis of the motor 710. For this reason any pivoting movement of the gearwheels 720 and 730 with the supports 740 and 750 will not change a spacing between the teeth of the gearwheels 720 and 730 and the axis of the motor 710. This in turn means that engagement between the teeth of the gearwheels 720 and 730 and the gearwheel 790 driven by the motor 710 is maintained irrespective of the relative rotational position between the gearwheels 720 and 730.

As is shown in FIG. 10D, in one position the openings 800 and 810 in the gearwheels 720 and 730 respectively are aligned with each other, so that a strand of hair can be passed through the so created opening. In the relative rotational position of the gearwheels 720 and 730 shown in FIG. 10E, the overlap between the openings 800 and 810 is reduced, so that the inside surface of the openings 800 and 810 can engage the strand of hair 820 from two (in this embodiment substantially opposite) sides.

It will be appreciated that rotation of the gearwheel 790 by the motor 710 causes a rotation of the two gearwheels 720 and 730. This rotation is in the same direction for both gearwheels 720 and 730, either clockwise or counter-clockwise, depending on the direction of rotation of the gear wheel 790. Given that the two gearwheels 720 and 730 engage the strand of hair 820 with substantially diametrically opposed parts of their respective inner surfaces 800 and 810, contact between the inner surfaces 800 and 810 causes a rotation of the strand of hair 820. A clockwise rotation of the two gearwheels 720 and 730, for example causes the gearwheel 720 to impart a downwardly (in FIGS. 10A to F) directed force onto the part of the strand of hair 820 that it contacts, while the gearwheel 730 imposes an opposing/upwardly directed force onto the (diametrically opposite) part of the strand of hair 820 that it contacts. The two gearwheels 720 and 730, acting in concert, therefore cause a clockwise rotation of the strand of hair 820 in this example. As can be seen from FIGS. 10A to 10D, the inner surfaces 800 and 810 of the gearwheels 720 and 730 are not smooth to aid engagement between these surfaces and the strand of hair 820. While FIGS. 10A to F show these surfaces as comprising gear teeth, this is not essential as any other surface irregularities or undulations that aid engagement without damaging the strand of hair 820 may be equally suitable.

A mechanical limiter may be provided to limit the pivoting of the supports 740 and 750 relative to each other, so that no undue force can be applied onto the strand of hair by the gearwheels 720 and 730.

Figure 11A:
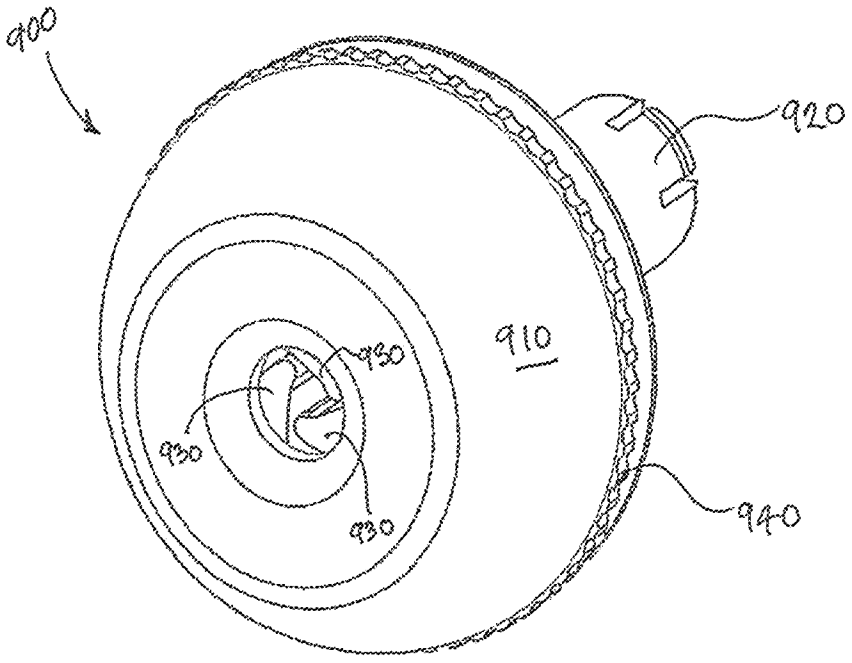
Figure 11B:
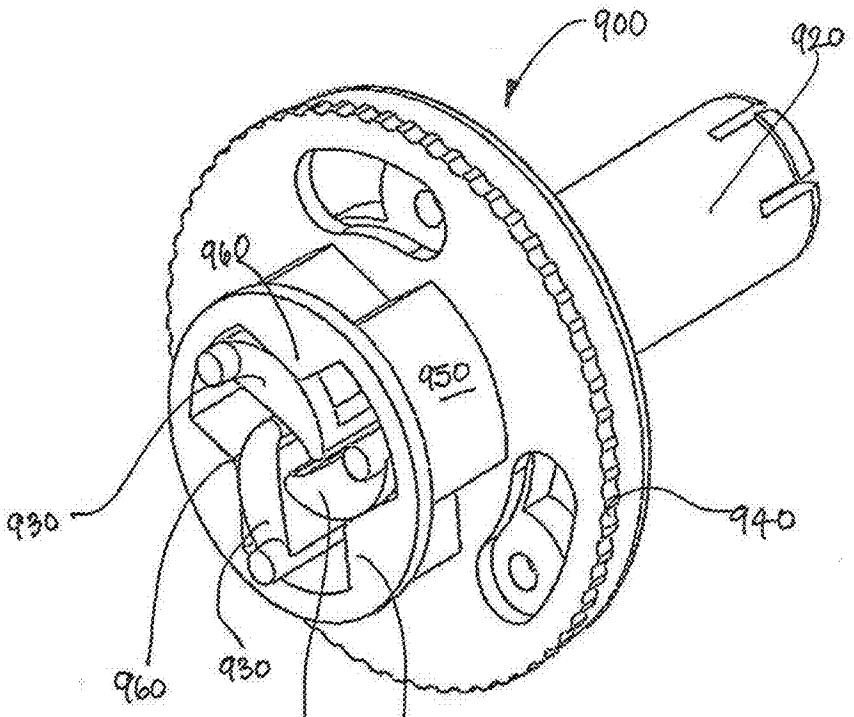
Figure 11C:
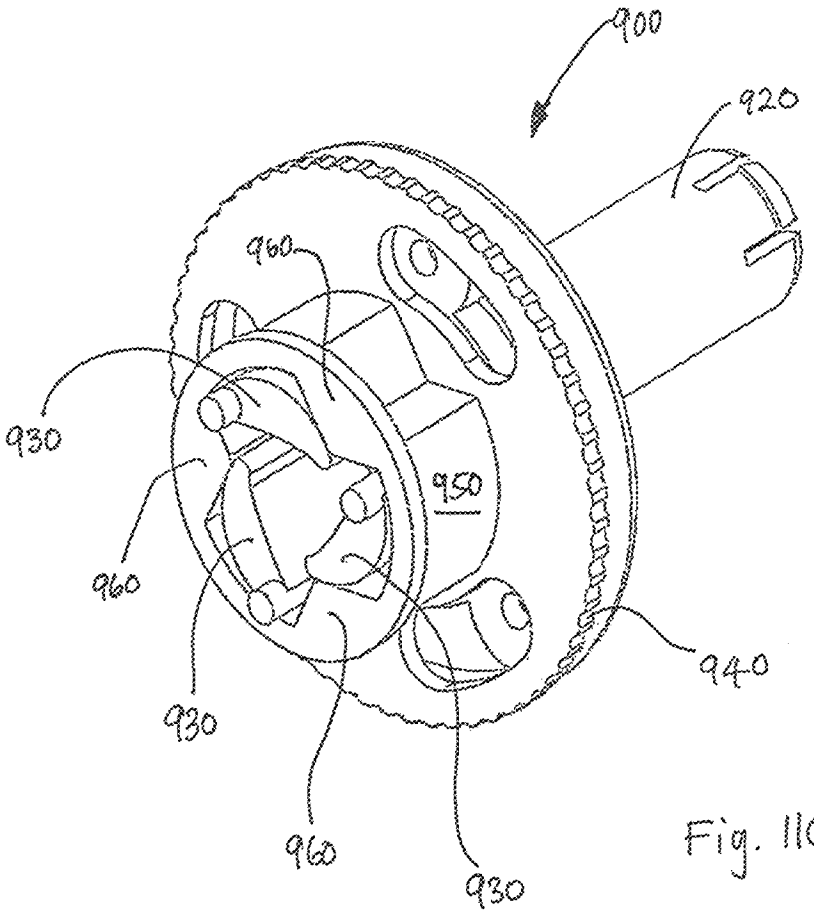

Turning now to FIGS. 11A to 11C, a further embodiment of the invention is disclosed in these figures. In FIG. 11A a view is provided showing the lock clamping mechanism 900 as it would be seen from the outside by a user (but omitting the motor unit shown in other embodiments described above). As can be seen, the clamping mechanism 900 comprises a cover 910 and a means 920 for attaching it to a remainder of the apparatus. Also visible in FIG. 11A are three clamping arms 930 and an activation ring 940. As can be seen from a comparison of FIGS. 11B and 11C, the clamping arms 930 can move from a position in which they are inwardly biased by the actuation ring 940 to engage a lock of hair (shown in FIG. 11B) to a position in which their clamping tips are moved away from the centre of the clamp, so that a lock of hair can be inserted through the opening of the clamping mechanism in the previously described manner.

As can be seen from FIGS. 11B and 11C, the clamping arms 930 are located within a housing 950. This housing comprises one shoulder 960 for each clamping arm 930. The clamping arms 930 are biased outwardly so that they contact the shoulders 960 at all times. The housing 950 can be rotated together with the actuation ring 940 relative to the clamping arms 930, so that the arms 930 move along the shoulders and are displaced inwardly against the spring bias to clamp a lock of hair located between the clamping arms 930. While the embodiment shown in FIG. 11 relates to a clamp that inhibits the twisting of a clamped strand of hair (much like the wires 240 shown in FIG. 1, it will be appreciated that, if the clamping mechanism 900 were rotated about its own longitudinal axis/the clamped strand of hair, then it could also impart a twisting motion onto the strand of hair.

Figure 12A:
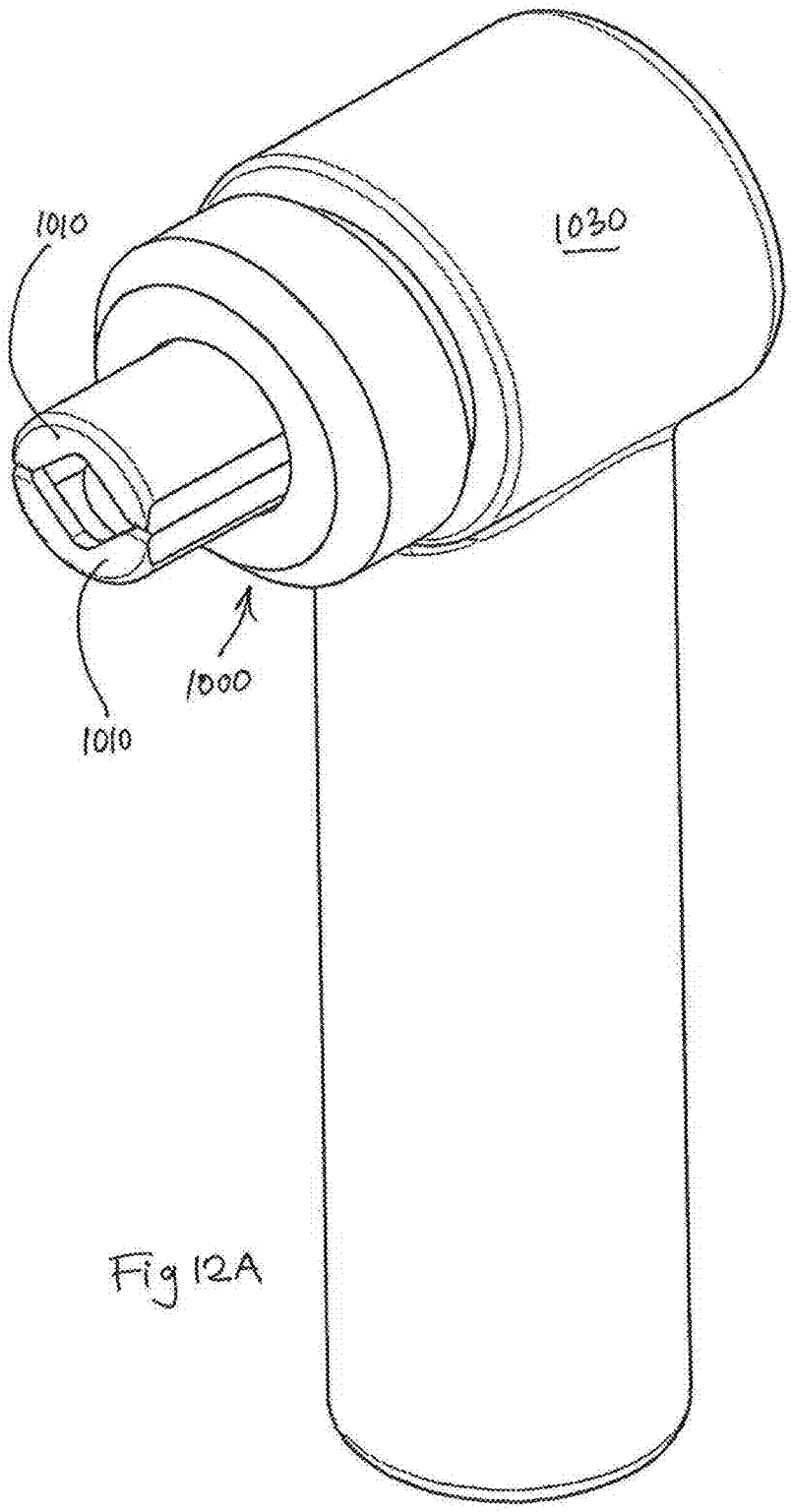
Figure 12B:
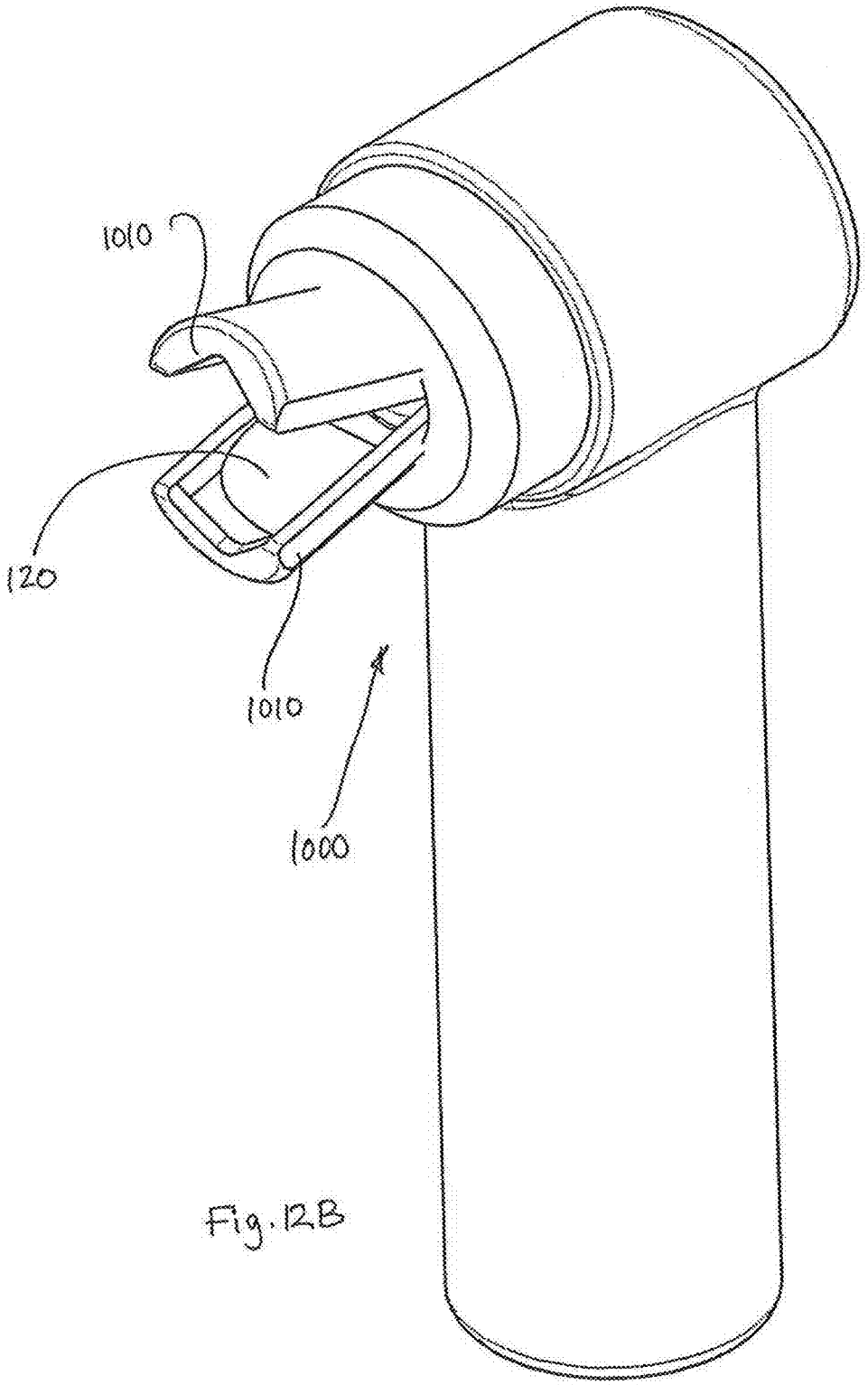
Figure 8A:
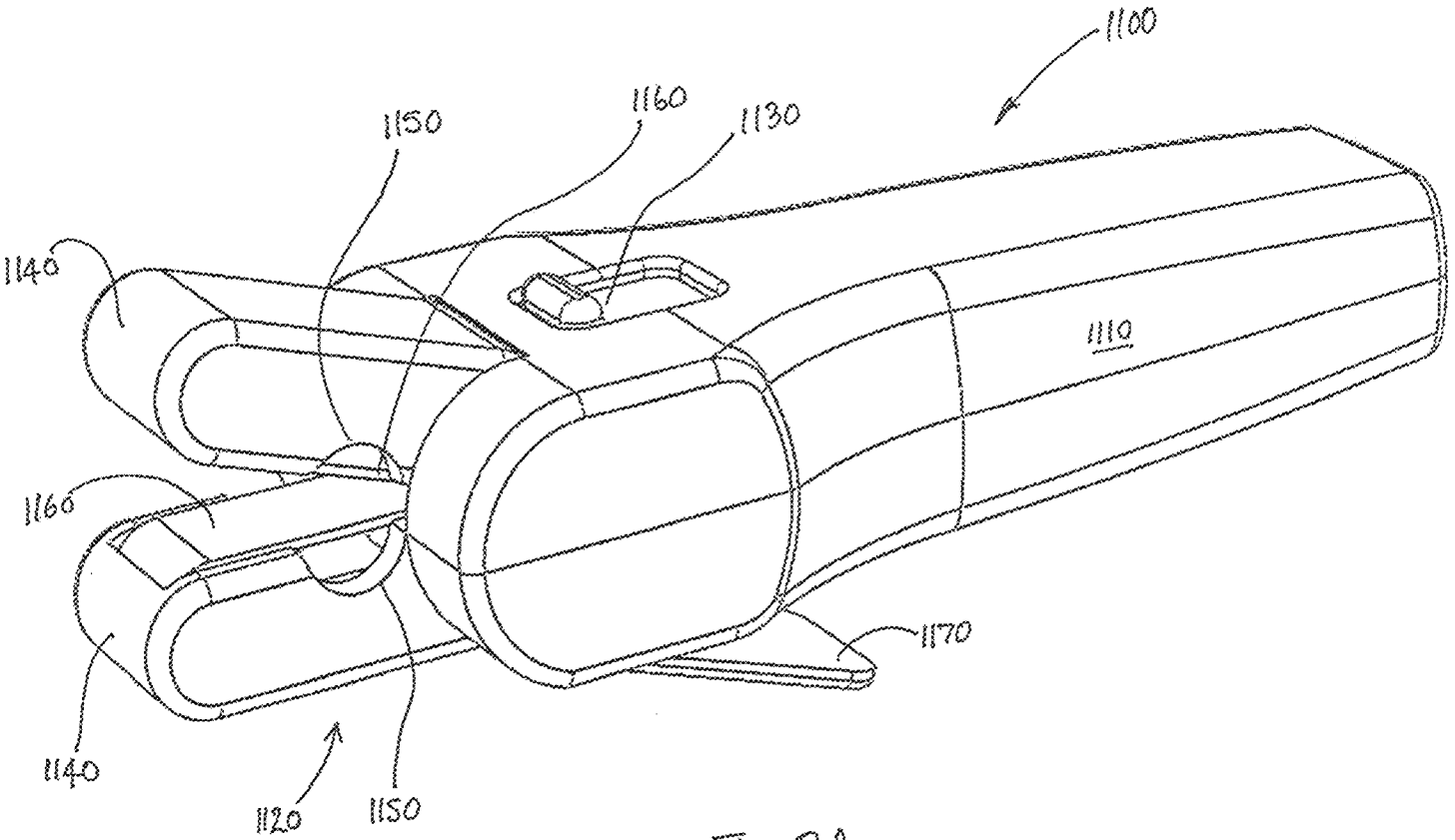

FIGS. 12A and 12B show a further embodiment of the invention. In this embodiment a lock of hair is again to be inserted through the upper part of the locking apparatus 1000. The locking apparatus comprises to pivotable jaws 1010 with a protrusion 1020 each on the inside. In the open formation shown in FIG. 12B, the jaws are moved away from each other, thereby permitting insertion of a strand of hair though the head 1030 of the locking apparatus. When the jaws 1010 are moved towards each other the protrusions 1020 engage the lock of hair. The lock of hair may extend through the head 1030 of the locking apparatus and extend out of the head 1030 on the right hand side shown in FIGS. 12A and 12B. In the embodiment shown the two jaws 1010 are jointly rotatable about the longitudinal axis of the head for locking of the hair. In an alternative embodiment the two jaws 1010 are not rotatable in this manner and instead simply hold the stand of hair to prevent or reduce twisting in analogy with the wires 240 shown in FIG. 1.

Figure 13B:
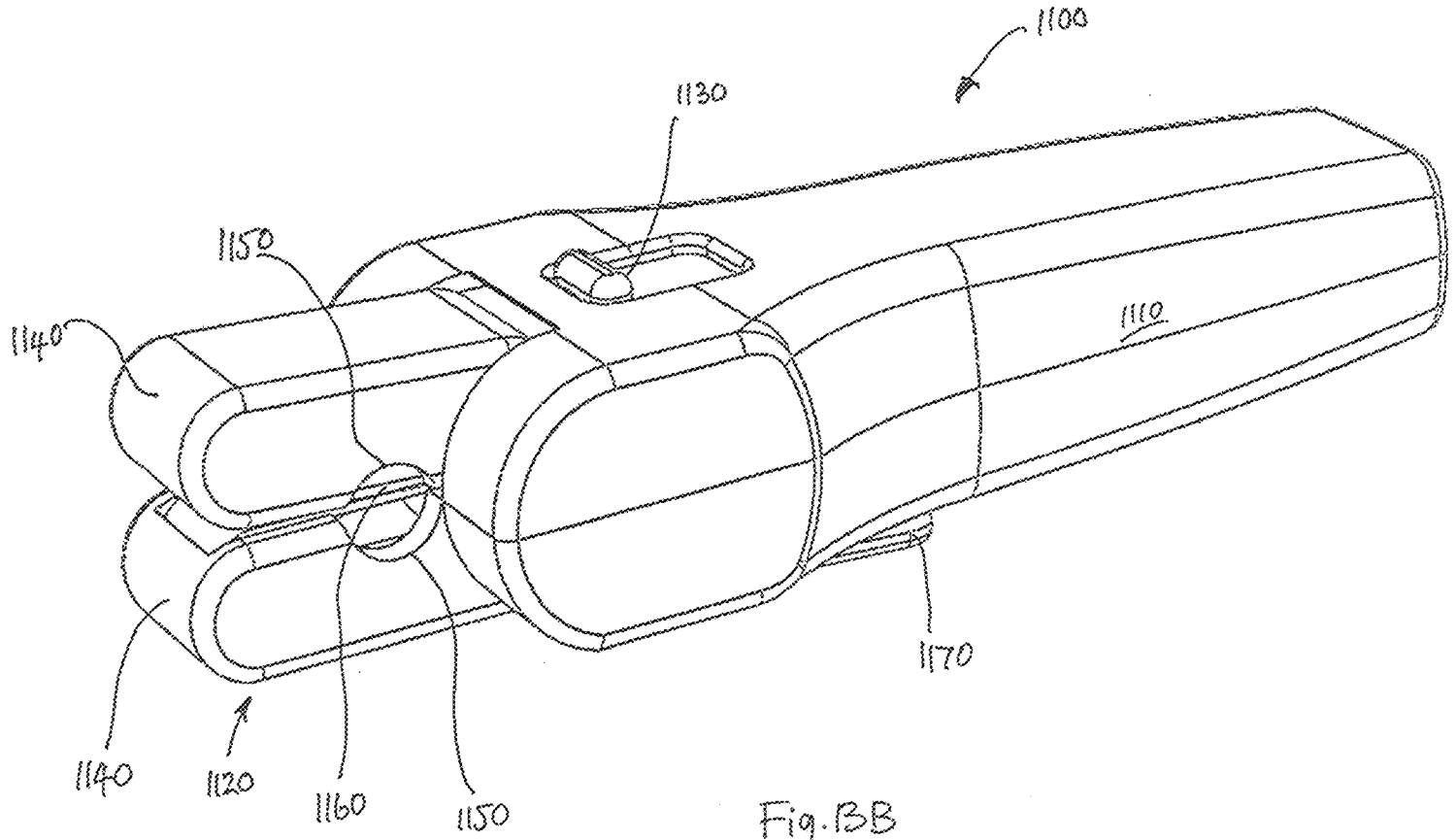

Turning now to FIGS. 13A to 13F, in the embodiment shown in these figures the apparatus 1100 is provided with a handle portion 1110 that comprises a motor and a battery and that is connected to a lock engagement portion 1120. The motor can be activated and deactivated via button 1130. The lock engagement portion 1120 comprises two jaws 1140 that are pivotably arranged relative to each other. Opposing recesses 1150 are provided on insides of the respective housings of the jaws 1140. These recesses allow a lock of hair to extend through the lock engagement portion 1120 in a direction perpendicular to the longitudinal direction of the apparatus 1100. Opposing belts 1160 are provided inside the jaws 1140. The operation of these belts 1160 will be discussed in detail below. A lever 1170 is fixedly connected to one of the jaws 1140 and may be spring biased towards the position shown in FIG. 13A. A user can press the lever 1170 towards the handle 1110, thereby pivoting the jaw 1140 it is connected to toward the jaw 1140 that is fixed to the handle 1110 and thus closing the gap between the jaws 1140, as shown in FIG. 13B.

Figure 13C:
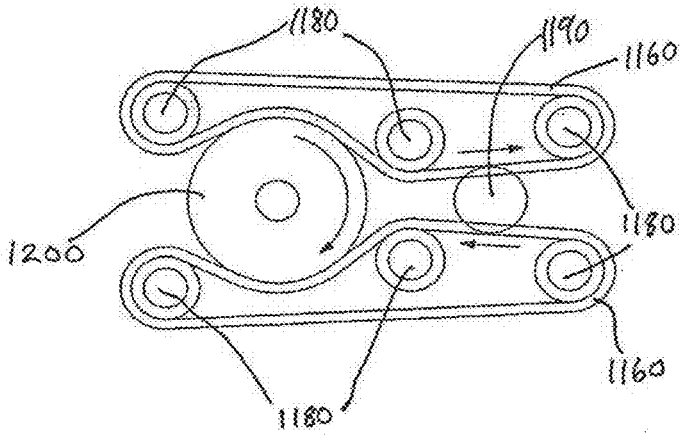
Figure 13D:
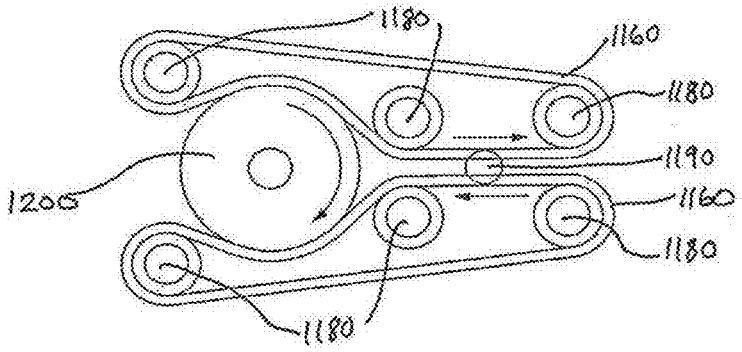
Figure 13E:
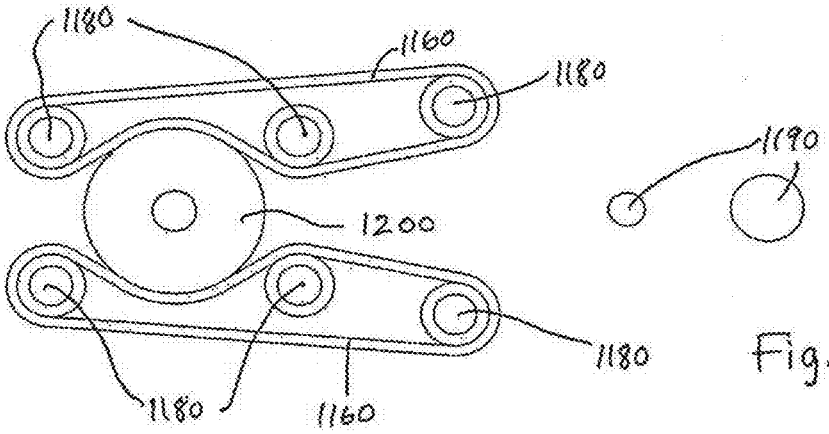

FIG. 13C shows the belts 1160 within the jaws 1140 in more detail. As can be seen from this figure, the belts 1160 can run over rollers 1180. FIGS. 13C and 13D show the belts 1160 in the closed position of the jaws 1140 also shown in FIG. 13B. In FIG. 13C the belts 1160 engage a thick lock of hair, while in FIG. 13D a thinner lock of hair is being engaged. This flexibility in engaging locks of hair of differing diameters is achieved by mounting the rollers 180 on a common base plate (not shown), which in turn can pivot in the illustrated manner.

The belts 1160 are further driveably engaged by the driving roller 1200. The driving roller is rotated by the motor in the handle portion 1110 shown in FIGS. 13A and 13B and causes the belts 1160 to run over rollers 1180. The belts 1160 in turn engage the locks of hair 1190 and rotate them, as indicated. It will be appreciated that best adjustability of the jaws 1140 is achieved, if the base plates upon which the rollers 1180 are mounted can pivot about the rotational axis of the driving roller 1200.

Figure 13F:
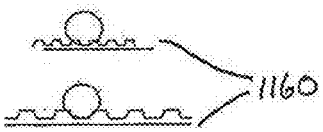

FIG. 13F shows different possible types of belt 1160 surfaces. As can be seen, the belt surfaces can be structured, in this example using trapezoidal protrusions. These protrusions help to engage and rotate the lock of hair. Belts 1160 with different protrusion types/sizes may be provided for different type/thickness of hair.

Figure 14A:
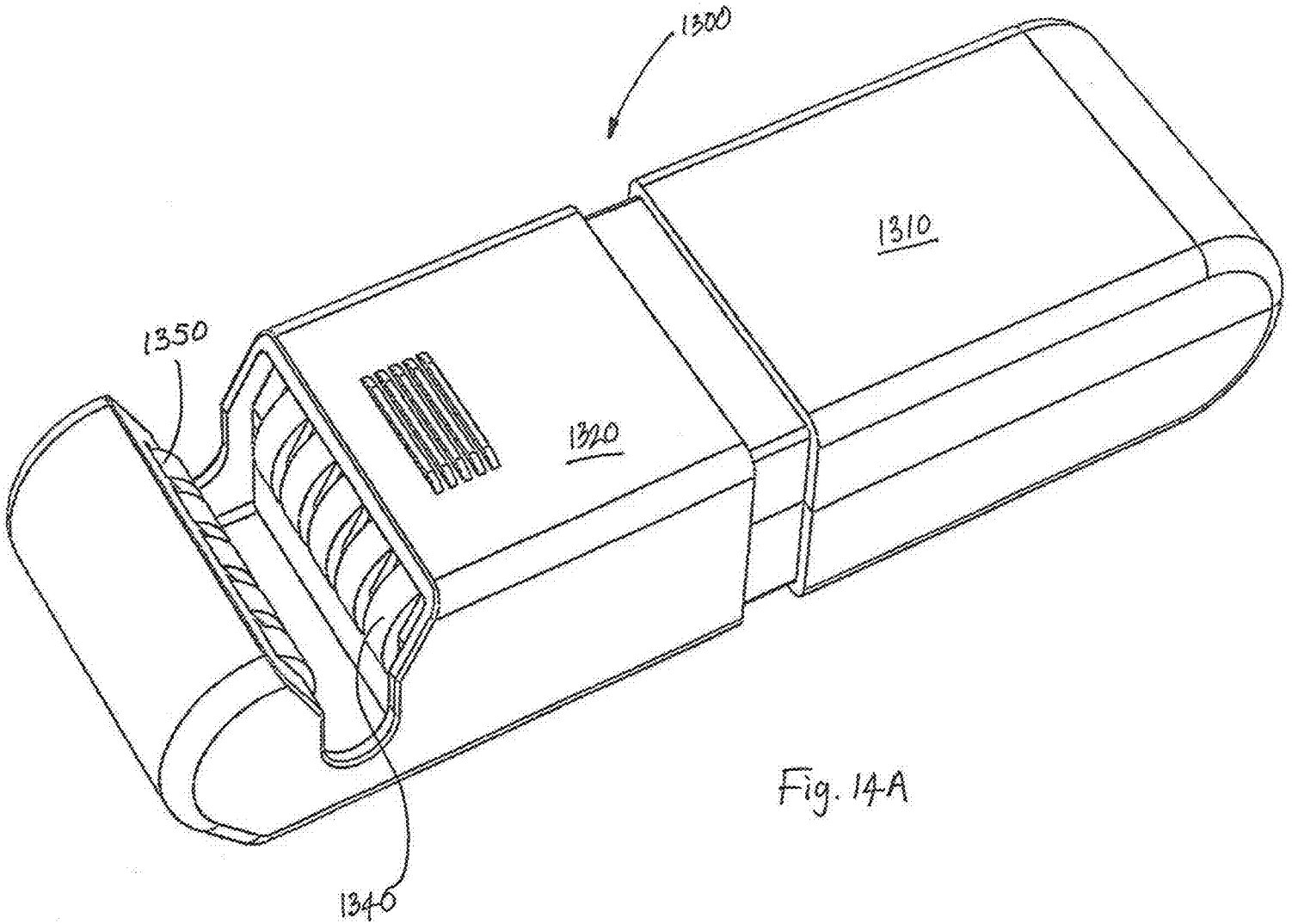
Figure 14B:
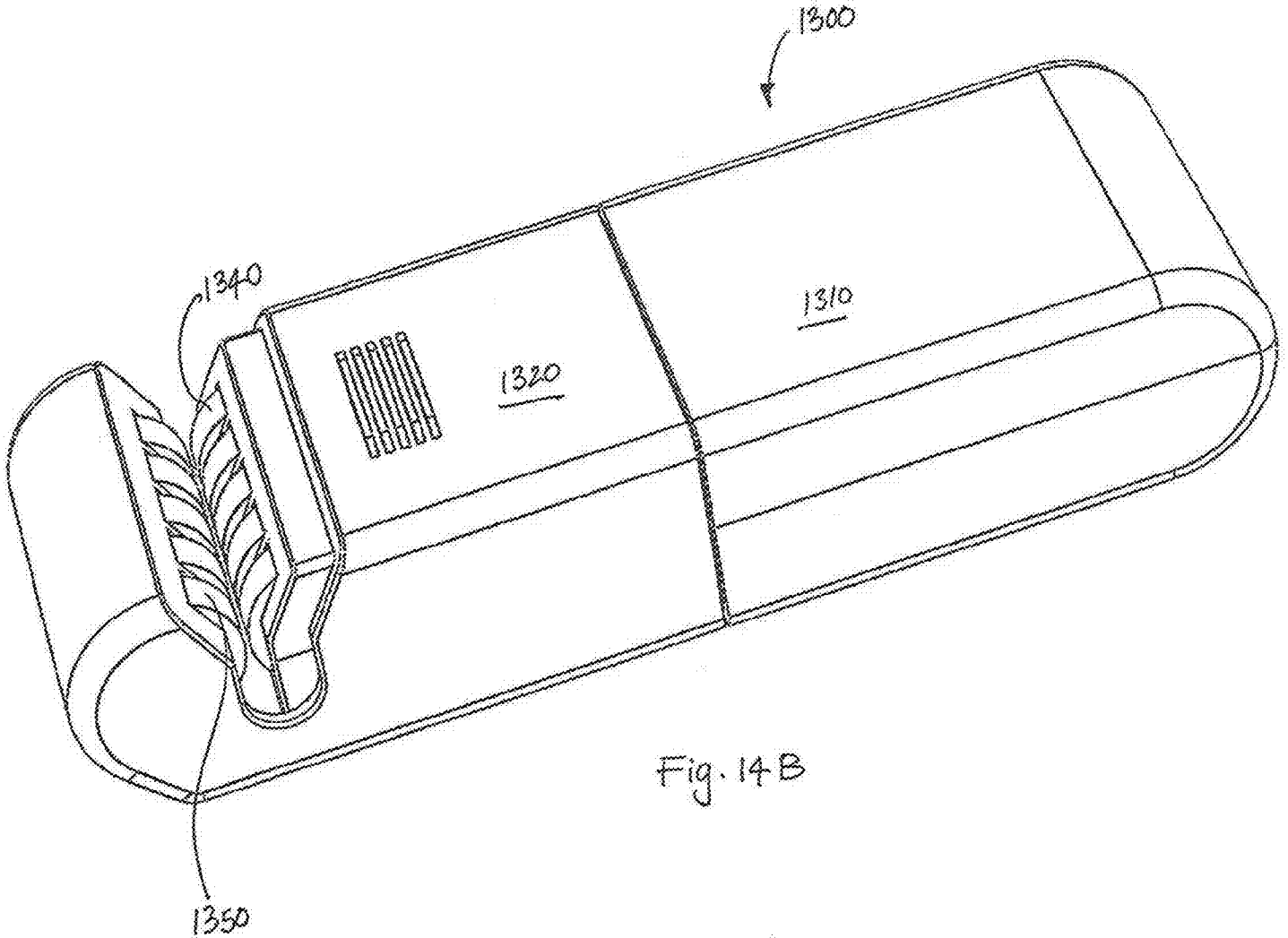

FIGS. 14A and 14B show another embodiment of the invention. The apparatus 1300 again comprises a handle portion 1310 (with motor and batteries) and a hair engagement portion 1320. The hair engagement portion 1320 can be slid relative to the handle portion 1310, as can be seen from a comparison of FIGS. 14A and 14B. Rollers 1340 are rotatably connected to the handle portion 1310 and rollers 1350 are rotatably connected to the hair engagement portion 1320. In one embodiment only the rollers 1340 are rotated by the motor in the handle portion 1310, in another embodiment both the rollers 1340 and the rollers 1350 are rotated by the motor in the handle portion 1310. When the rollers 1340 and 1350 are in the position shown in FIG. 14B they can engage a lock of hair and, through their rotation by the motor, rotate the lock of hair.

FIGS. 15 and 16 show to further ways of engaging locks of hair. Both of these further embodiments are for use in an apparatus in which a lock of hair is fed through the apparatus. FIG. 15A shows an arrangement 1400 that comprises two rings 1410 through which a strand of hair 1430 is fed. Connected between the rings are spring wires 1420. As can be seen from FIG. 15A, for one relative rotational position of the rings 1410 the wires 1420 extend substantially parallel to the lock of hair 1430. In this configuration an opening is formed between the wires 1420, allowing feeding of a lock of hair through the assembly 1400. When the rings 1410 are rotated relative to each other so that or until the wires 1420 extend tangentially to the strand of hair 1430, then the wires 1420 engage the strand of hair 1430. The two rings can then be rotated by the motor in this configuration and in unison about the axis of the strand of hair.

Figure 16A:
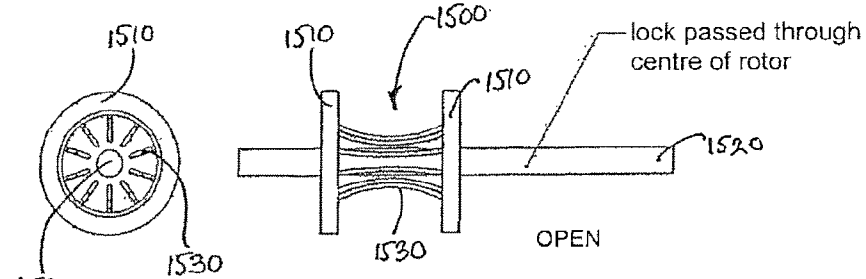

FIG. 16A shows another embodiment with an arrangement 1500 similar to that shown in FIGS. 15A and 15B. The arrangement 1500 comprises two rings 1510 spaced apart along their axis of rotational symmetry. This axis coincides with the axis of the strand of hair 1520 that is to be locked and, for this purpose, to be inserted through the openings in the rings 1510. The rings 1510 are connected via resilient curved wireforms 1530 and can be displaced along their axis of symmetry relative to each other. In the configuration shown in FIG. 16A the rings 1510 are space further apart from each other than in the configuration shown in FIG. 16B, and therefore stretch the wireforms 1530 more than in FIG. 16B. For this reason more space is provided at the centre of the embodiment as shown in FIG. 16A than in the centre of the embodiment when it is in the configuration shown in FIG. 16B. In the latter configuration the strand of hair 1520 is engaged and can be locked by rotating the ring 1510 and wireform 1530 arrangement about its axis of rotational symmetry.

Figure 17A:
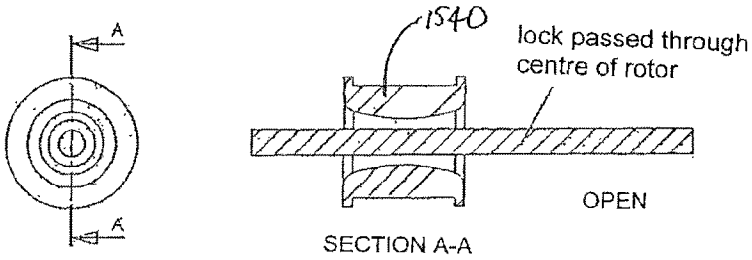
Figure 17B:
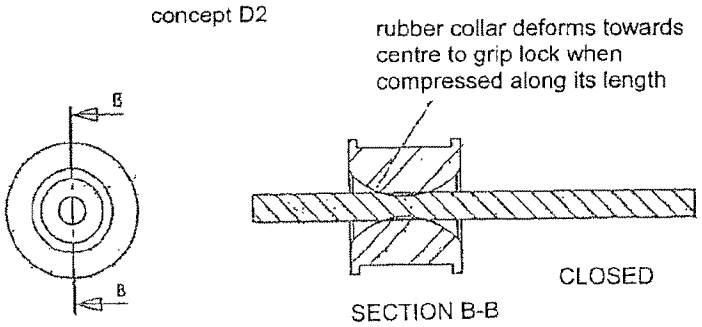
Figure 16B:
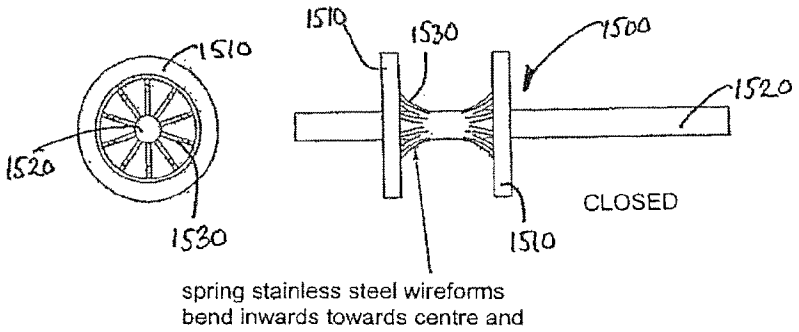

FIGS. 17A and 17B show a further embodiment of the invention that is similar to that shown in FIGS. 16A and 16B but in which the two rings 1510 and the wireforms 1530 are replaced by an elastically deformable member 1540 that comprises an open bore that is adapted to narrow upon longitudinal compression of the elastically deformable member 1540. Such compression leads to a releasable engagement of the strand of hair 1520.

Figure 18:
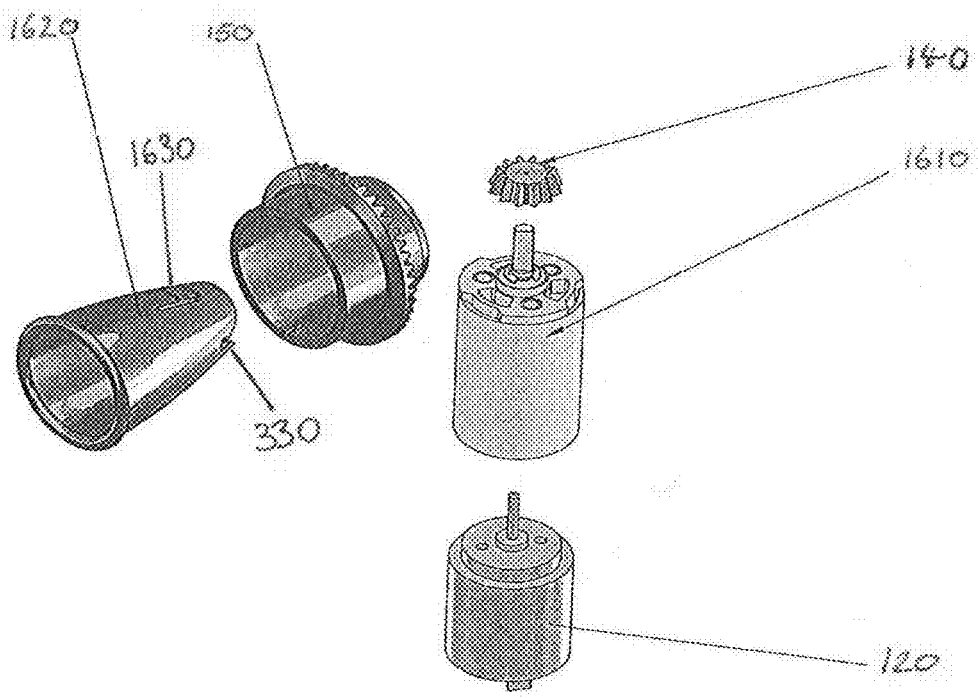

FIG. 18 shows a further embodiment of the invention similar to that shown in FIG. 2. A motor 120 drives a gearbox 1610 which rotates a first bevel gear 140. The first bevel gear 140 drives a second bevel gear 150. A tubular structure 1620 may be located inside of, and driven by, the second bevel gear 150. In operation, a strand of hair could be fed into the tubular structure and engaged by recesses 330 located at one end of the tubular structure 1620.

The tubular structure 1620 may have a wider opening at the end of the structure into which the stand of hair is intended to be inserted than at the other end. This would allow the hair to be easily fed into the tubular structure 1620 whilst still allowing for the hair to lock properly upon rotation. To further aid this, the internal surface of the tubular structure 1620 may taper inwards from one end to the other.

In addition, one or more resilient members 1630 may be provided on the tubular structure 1620. Each of the resilient members 1630 comprises a protrusion at a free end thereof. These protrusions may engage with corresponding recesses (not shown) on the inside of the second bevel gear 150 in a snap fit arrangement. This would allow the tubular structure 1620 to be removed from the device. This is beneficial as it would allow for the tubular structure 1620 to be cleaned and could facilitate maintenance. It is particularly advantageous to be able to easily clean the tubular structure 1620 as, during operation, it is likely to have extensive contact with hair which is may be coated in wax.

Providing the tubular structure such that it can be removed from the other parts of the apparatus also allows the use of different tubular structures. A number of tubular structures could, for example, be provided, wherein the inner diameter of the tubular structure at the end at which the strand of hair is inserted or at the opposite end may differ between different between different tubular structures in the set to allow for locking of different diameter strands of hair.

The tubular structure shown in FIG. 18 also comprises a conical cut in its side wall, opening into a circular opening at its apex for receiving and holding a strand of hair. In addition to the above discussed differences in the internal diameter of the tubular structures, or alternatively thereto, different tubular structures in the set may have conical cuts that taper to different size end openings, so that different diameter strands of hair can be engaged for locking.

It will be appreciated that whilst FIG. 18 and the accompanying description describe one arrangement, the invention is not confined to this one configuration. The invention may include a tubular structure 1620 with a tapered inside surface but might not have snap fits 1630. Equally, the tubular structure 1620 may include snap fits 330 but may not have a tapered inside surface.

It will be appreciated that the above description has been made by way of example only. Various modifications may be implemented by the person skilled in the art, some of which are elaborated upon, albeit again by way of example only. If the strand of hair is engaged by a surface (rather than through engagement by way of a geometry that holds, grips or traps the strand of hair in a way that allows twisting of the strand of hair) the surface may have properties which prevent an undue twisting of the strand of hair. The surface may, for example be configured so that the amount of torque that can be applied to the strand of hair is limited. The surface may, for example have a roughness or unevenness that helps engage the strand of hair under the influence of a biasing of the strand of hair against the surface, while at the same time being made of, coated with or comprising a low friction material that allows slippage between the strand of hair and the surface if the amount of torque applied to the strand of hair is above a maximum value.

Alternatively or additionally the motor may be configured so that the maximum amount of torque that it can create is such that the amount of torque that can be applied to the strand of hair (when taking into account any torque conversion that may be achieved by the driveable connection between the motor and the holder) is such that it cannot exceed the maximum value.

Alternatively or additionally a clutch mechanism may be provided as part of the drivable connection between the motor and the holder, wherein the clutch causes a transmission of the motor's rotation to the holder if the torque applied to the strand of hair is below the maximum value and disconnects the drivable connection between the motor and the holder if the torque applied to the strand of hair is above the maximum value. Put in other words, the clutch can be configured to transmit movement if the resistance to such transmission that it experiences is below a desired value and to impede transmission of such movement if the resistance to the transmission of movement is above the desired value.

The apparatus may moreover have a speed adjustment means to allow users of varying skill to perform satisfactory and safe locking.

It will be appreciated that, while certain of the above embodiments comprise fixation means for impeding a twisting motion of the strand of hair (for example the wires 240 shown in FIG. 1, such fixation means are entirely optional and may not be used in other examples.

While the present invention has been described above with reference to examples, these examples are not limiting and the scope of the present invention is defined by the following claims.

What is claimed is:

1. An apparatus for locking a strand of hair, the strand of hair including a plurality of hairs, the apparatus comprising:

a holder having (i) a tubular structure with a generally conical shape for receiving the strand of hair therethrough, the tubular structure having a wider opening at a wide end thereof and a narrow opening at a narrow end thereof, (ii) a plurality of narrowing slits in a wall of the tubular structure, each of the narrowing slits terminating in a corresponding partial-circular recess at a first end thereof for engaging at least a portion of the strand of hair received through the wide end of the tubular structure, wherein each of the narrowing slits is widest at the narrow end of the tubular structure and narrows toward the wide end until terminating at the corresponding partial-circular recess, and (iii) a resilient member having a protrusion at a free end of the resilient member;

a first bevel gear;

a second gear mechanically engaging the first bevel gear, the second gear receiving the tubular structure through an opening of the second gear, the resilient member of the tubular structure being configured to engage a corresponding recess on an inside of the second gear in a snap fit arrangement to allow the tubular structure to be snapped into and removed from the second gear; and an electric motor configured to drive the first bevel gear such that operation of the electric motor causes the holder to rotate, thereby locking at least a portion of the strand of hair engaged by the narrowing slits of the tubular structure.

* * * * *